US005215702A

United States Patent [19]

Bruneel

[11] Patent Number: 5,215,702

[45] Date of Patent: Jun. 1, 1993

[54] AVOIDING LEAD DRAG-OUT DURING PATENTING

[75] Inventor: Eric Bruneel, Roeselare, Belgium

[73] Assignee: N.V. Bekaert S.A., Zwevegem, Belgium

[21] Appl. No.: 761,922

[22] PCT Filed: Apr. 5, 1990

[86] PCT No.: PCT/EP90/00564

§ 371 Date: Sep. 13, 1991

§ 102(e) Date: Sep. 13, 1991

[87] PCT Pub. No.: WO90/13674

PCT Pub. Date: Nov. 15, 1990

[30] Foreign Application Priority Data

May 10, 1989 [BE] Belgium ..... 8900503

[51] Int. Cl.[5] ..... C21D 9/64; C21D 9/573

[52] U.S. Cl. ..... 266/44; 266/130; 266/133

[58] Field of Search ..... 266/112, 120, 130, 133, 266/44; 148/15, 18, 242, 277

[56] References Cited

U.S. PATENT DOCUMENTS

| | | | |
|---|---|---|---|
| 979,931 | 12/1910 | Cowper-Coles | 266/112 |
| 1,052,574 | 2/1913 | Davis | 266/112 |
| 3,181,977 | 5/1965 | Sturgeon | 148/13.1 |
| 3,669,761 | 7/1970 | Schulze et al. | 148/15 |
| 3,858,859 | 1/1975 | Baguet | 266/112 |
| 4,954,183 | 9/1990 | DeWitte | 148/15 |

FOREIGN PATENT DOCUMENTS

| | | |
|---|---|---|
| 568949 | 12/1960 | Belgium . |
| 58-217640 | 12/1983 | Japan . |
| 41148 | 3/1962 | Luxembourg . |

*Primary Examiner*—Scott Mastler
*Attorney, Agent, or Firm*—Foley & Lardner

[57] ABSTRACT

A method of and an apparatus for guiding at least two steel wires from a furnace into a lead bath. The steel wires are kept separated, and, after leaving the furnace, guided over a cooled roller. The roller is turning at a peripheral speed that nearly equals the speed of the steel wires. After this, the steel wires disappear into the lead bath and are guided further under an immersed roller, the steel wires making an angle larger than 150° over the cooled roller and under the immersed roller. The furnace-lead bath transition is sealed by a hood that lets through as little air as possible.

10 Claims, 1 Drawing Sheet

AVOIDING LEAD DRAG-OUT DURING PATENTING

BACKGROUND OF THE INVENTION

1. Field of the Invention

The invention relates to a method of and an apparatus for guiding at least one steel wire from a furnace into a lead bath, which method is carried out in such a manner that lead drag-out from the lead bath is avoided as much as possible.

2. Discussion of the Related Art

The use of lead tanks or lead baths for heat treatments is sufficiently known in the state of the art. Everywhere where these lead tanks or lead baths are used, one is faced with the problem of lead drag-out. That is, along with the objects to be treated such as steel wires, lead is dragged out of the lead tanks or lead baths in the form of lead drops, whether or not enveloped in a lead-oxide skin. This results in different drawbacks. In the first place, there is the known harmful effect on health and the environment. Further, there is also a qualitative drawback in the sense that the baths located downstream of the lead bath are "poisoned" by the lead particles dragged along. This does not benefit the quality of the treatment connected with these baths downstream. Moreover, wire products for certain applications do not tolerate lead drag-out, for instance those wire products that are electrolytically coated afterwards. Finally, there is the considerable loss of lead itself.

The problem of lead drag-out is a complex problem and presents chemical, physical as well as mechanical aspects.

Therefore, the state of the art presents different solutions to avoid lead drag-out.

Thus, it is sufficiently known from U.S. Pat. No. 3,669,761 to cover the end of the lead bath with a coal bed to avoid the formation of lead oxides ($Pb_xO_y$). Indeed, lead oxides have the property of being more viscous than lead at the temperatures that prevail at the end of the lead bath, and they are more readily than lead dragged out of the lead bath along with the wires. They also drag pure lead along in the process. A further purpose of the lead bed is to mechanically stop the lead dragged along.

However, despite these well known measures, lead drag-out has remained a major problem wherever lead baths are used.

SUMMARY OF THE INVENTION

It is now an object of the present invention to reduce further the lead drag-out.

According to a first aspect of the present invention, there is provided a method of guiding at least one steel wire from a furnace into a lead bath, whereby the steel wires are kept separated, and, after leaving the furnace, guided over a cooled roller. This roller turns at a peripheral speed that nearly equals the speed of the steel wires. After that, the steel wires disappear into the lead bath and are guided further under an immersed roller. Over the cooled roller and under the immersed roller, the steel wires make an angle that is larger than 150°. The furnace—lead bath transition is sealed by a hood that lets through as little air as possible.

This invention is particularly suitable for a patenting process, which, as is sufficiently known, consists in heating the wire in a furnace to austenitising temperature (about 950° C.) and thereupon cooling the wire at about 500° to 600° C., mostly in a lead bath.

The effect of the above-mentioned features of the invention on the lead drag-out may be explained as follows:

The inventor has discovered that lead drag-out can be reduced further still if the steel wires are covered with a thin oxide skin. Indeed, ferric oxide and lead do not react. All the features of the invention tend to prevent the oxides on the steel wires from flaking.

The steel wires can for instance be kept separated by the teeth of a comb. These teeth must not touch the steel wires. Their only function is to keep the steel wires separated. To prevent deformations of the comb, in view of the very high temperatures at the furnace exit, the comb is preferably cooled with water. If the teeth of the comb touch the steel wires, the oxide scale on the steel wires can flake and lead is dragged out of the lead bath. Preferably, there is a certain distance between the furnace exit and the comb so that any loose soap residue that are still lying on the steel wires as a result of a previous cold-drawing process when the steel wires leave the furnace, falls into the lead bath and not onto the comb.

Another way to keep the steel wires separated is the use of a cooled roller that consists of consecutive cylindrical parts, a part with a larger diameter succeeding a part with a smaller diameter. The steel wires are guided over the part with the smaller diameter. The part with the larger diameter, in between two steel wires, keeps the steel wires separated.

Preferably, the cooled roller is cooled with water. Cooling must in any case be adequate to prevent deformations. The peripheral speed of the roller or of that part of the roller that is in contact with the steel wires must be nearly equal to the speed of the steel wires. If this is not the case, the risk that the oxide scale will flake increases.

The part of the steel wires that reaches the roller makes an angle with the part of the steel wires that leaves the roller so that the steel wires disappear a bit further downstream into the lead bath. Preferably, this angle must be as large as possible, larger than 150° for instance, and most preferably larger than 160°, for instance 165°.

If a stationary comb is used instead of a rotary roller to make this angle, there is a far greater risk of flaking of the oxide scale because of the difference in relative speed between the comb and the steel wires. Further, this angle is made much smoother by a roller than by a comb. Indeed, the more gradual the change of direction of the steel wires, the smaller the risk of flaking of the oxide scale.

The angle made by the steel wires under the immersed roller must also be larger than 150°, and most preferably larger than 160° because of the reasons mentioned above.

The whole of the furnace—lead bath transition is sealed by a hood that lets through as little air as possible. This does not mean, however, that this hood must not have any openings. Indeed, openings are necessary for the cooling pipes of roller and comb and for the roller itself. The fact is that the furnace is under slight overpressure and consequently also the part under the hood. Now, the openings must be limited to such a degree that, in view of this overpressure, as little air as possible penetrates. If too much air penetrates, the oxide scale on the steel wires will thicken and turn brittle so that it will flake readily causing lead drag-out further down. According to a second aspect of the present invention there is provided an apparatus for guiding at least one steel wire from a furnace into a lead bath, the apparatus comprising means for keeping the steel wires separated from each other, and further comprising a first cooled driven roller situated above the lead bath, a second roller immersed in the lead bath and means for sealing as much as possible the furnace—lead bath transition.

BRIEF DESCRIPTION OF THE DRAWINGS

A particular embodiment of the invention will now be explained further with reference to the following drawing, in which FIG. 1 gives a view of the furnace—lead bath transition without hood.

DETAILED DESCRIPTION OF THE PREFERRED EMBODIMENTS

Figure 1:
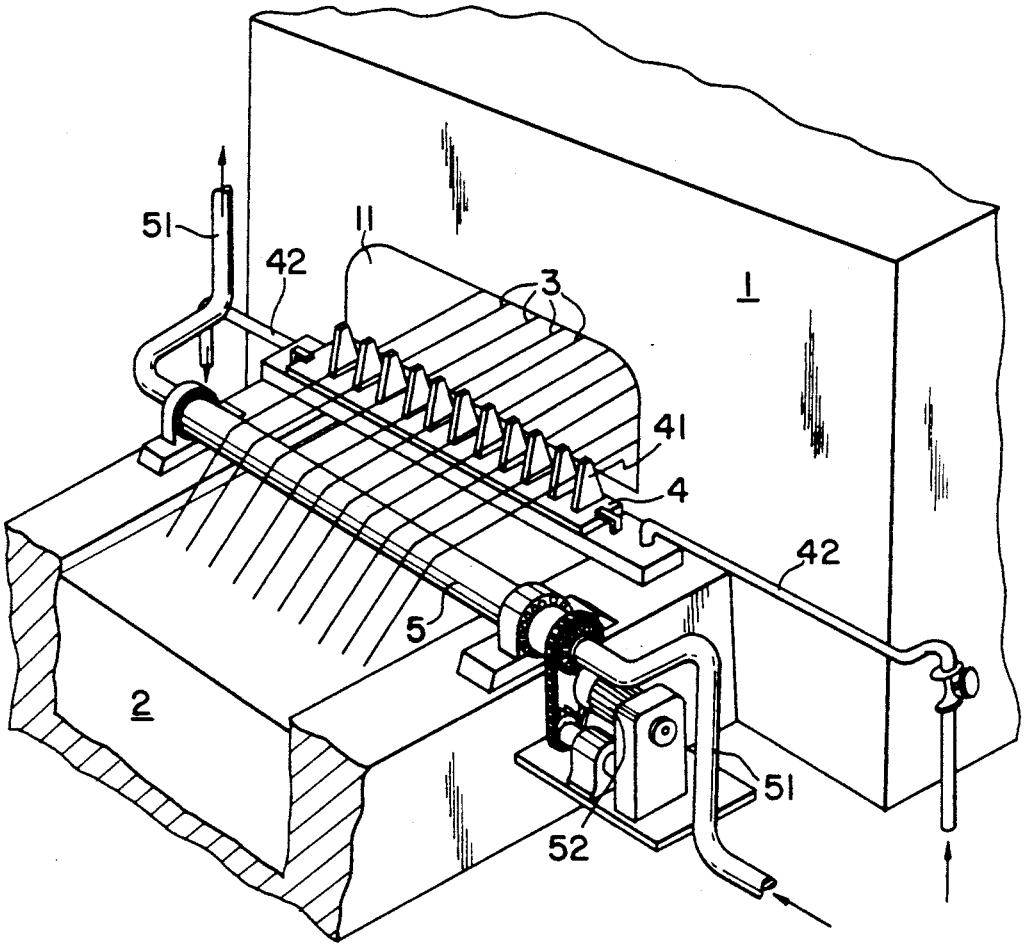
Figure 2:
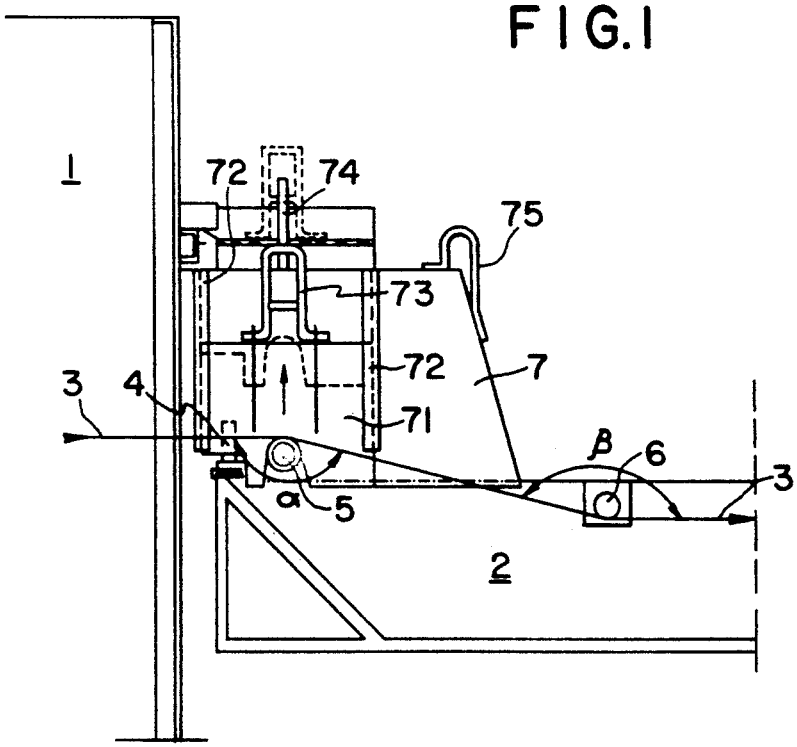
FIG. 2 is a side view of the furnace—lead bath transition with hood.

FIG. 1 represents a furnace—lead bath transition in accordance with the invention. The hood is not represented for the sake of clarity. The hood is shown in FIG. 2.

The steel wires 3 leave the furnace 1 via the opening 11. A comb 4 has been placed at a certain short distance from the opening 11 so that soap rests do not fall on the comb 4. The comb 4 is cooled with water via the pipe 42. The teeth 41 of the comb 4 do not touch the steel wires 3 and are only there to keep the steel wires 3 separated.

If soap residue, coming from previous cold-drawing processes, should collect between the teeth of the comb, this can affect the direction of movement of one or several steel wires. This must be avoided at all costs. The comb must therefore be cleaned regularly.

The steel wires 3 then make a smooth, large angle over the cooled roller 5 before disappearing into the lead bath 2.

The roller 5 is cooled with water via a pipe 51 and is driven with a motor 52 in such a way that it turns at a peripheral speed that is nearly equal to the speed of the steel wires 3.

The steel wires 3 are guided further under an immersed roller 6 (FIG. 2). Preferably, the angle made by the steel wires is as large as possible.

The whole of the furnace—lead bath transition is covered by a hood 7. The hood 7 has as minimal openings as possible, for instance only to accommodate the roller 5, the cooling pipe 51 and the cooling pipe 42. The bottom of the hood 7 comes down to below the lead level in the lead bath 2.

For small services, that is, for cleaning the comb, the hood 7 is provided with a small door 71. The door 71 slides upwards in the slots 72 via a lever mechanism 73–74 and maintenance can take place. To close the door, it suffices to stop exerting a force on the lever mechanism 73–74 or to unlock the lever mechanism so that the door falls to again via the slots 72 by the force of its own weight. This way, the door is always closed and undesirable air penetration is avoided unless specifically wanted.

The hood 7 is further provided with a hook 75 so that the whole hood 7 can be pulled up via a cable and a pulley (not represented) for further service.

I claim:

1. A method of guiding at least two steel wires from a furnace into a lead bath over a furnace-lead bath transition, comprising the steps of:

a) keeping the steel wires separated;

b) turning a cooled roller at a speed that approximately equals the speed of the steel wires;

c) after the steel wires leave the furnace, guiding the steel wires over the cooled rollers, at an angle larger than 150°;

d) guiding the steel wires into a lead bath;

e) guiding the steel wires under an immersed roller at an angle larger than 150°; and f) sealing the furnace-lead bath transition by a hood that lets through as little air as possible.

2. A method of guiding at least two steel wires from a furnace into a lead bath over a furnace-lead bath transition, the steel wires being covered with an oxide skin, comprising the following steps in order to prevent the oxide skin from flaking:

keeping the steel wires separated;

guiding the steel wires over a cooled roller, which roller is turning at a peripheral speed that approximately equals the speed of the steel wires;

guiding the steel wires under an immersed roller, the steel wires making an angle larger than 150° over the cooled roller and under the immersed roller; and sealing the furnace-lead bath transition by a hood that lets through as little air as possible.

3. A method in accordance with claim 1, wherein the steel wires are kept separated by the teeth of a comb without the steel wires touching the teeth.

4. A method in accordance with claim 3, further comprising the step of cooling the comb with water.

5. A method in accordance with claim 3, further comprising the step of placing a predetermined distance between the comb and an exit of the furnace so that any loose soap residue remaining on the steel wire can fall into the lead bath.

6. An apparatus for guiding at least two steel wires from a furnace into a lead bath comprising:

means for keeping the steel wires separated from each other, a first cooled driven roller situated above the lead bath, a second roller immersed in the lead bath, and means for sealing the furnace-lead bath transition.

7. An apparatus according to claim 6, wherein the means for keeping the steel wires separated from each other includes a comb provided with teeth.

8. An apparatus according to claim 7, further comprising means for cooling the comb.

9. An apparatus according to claim 8, wherein the comb is situated at a distance from an exit of the furnace so that any loose soap residue remaining on the steel wires can fall into the lead bath.

10. An apparatus according to claim 6 wherein the means for keeping the steel wires separated from each other includes a roller having consecutive cylindrical parts, a part with a larger diameter succeeding a part with a smaller diameter, the steel wires being guided over the part with the smaller diameter.

* * * * *